US009121411B2

(12) United States Patent
Ito

(10) Patent No.: US 9,121,411 B2
(45) Date of Patent: Sep. 1, 2015

(54) MOTOR DRIVEN COMPRESSOR AND HERMETIC SEALING INSPECTION METHOD FOR THE SAME

(71) Applicant: KABUSHIKI KAISHA TOYOTA JIDOSHOKKI, Kariya-shi, Aichi-ken (JP)

(72) Inventor: Tatsuya Ito, Aichi-ken (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 258 days.

(21) Appl. No.: 13/731,192

(22) Filed: Dec. 31, 2012

(65) Prior Publication Data

US 2013/0202411 A1 Aug. 8, 2013

(30) Foreign Application Priority Data

Feb. 2, 2012 (JP) ..... 2012-020657

(51) Int. Cl.
*F04C 29/00* (2006.01)
*F04D 29/10* (2006.01)
(Continued)

(52) U.S. Cl.
CPC ..... *F04D 29/102* (2013.01); *F04B 39/121* (2013.01); *F04B 51/00* (2013.01);
(Continued)

(58) Field of Classification Search
CPC ..... F04B 39/12; F04B 39/121; F04B 17/03; F04D 29/40; F04D 29/60; F04C 2230/60; F04C 2230/604; F04C 2240/40; F04C 2240/803; F04C 2240/808; F04C 2270/80; Y10S 439/91; Y10S 439/926
USPC ..... 417/423.7, 423.14, 423.9
See application file for complete search history.

(56) References Cited

U.S. PATENT DOCUMENTS 5,071,413 A * 12/1991 Utterberg ..... 604/533
8,210,833 B2 * 7/2012 Egawa et al. ..... 417/423.14
(Continued)

FOREIGN PATENT DOCUMENTS

CN 2483707 Y 3/2002
CN 1678829 A 10/2005
(Continued)

OTHER PUBLICATIONS

Machine Translation of Abstract for JP2009287440A dated Dec. 2010.*
(Continued)

*Primary Examiner* — Devon Kramer
*Assistant Examiner* — Nathan Zollinger
(74) *Attorney, Agent, or Firm* — Sughrue Mion, PLLC

(57) ABSTRACT

A motor-driven compressor includes a compression mechanism compressing and discharging fluid, an electric motor driving the compression mechanism, a drive circuit controlling the electric motor, a drive circuit chamber accommodating the drive circuit and a hermetic sealing inspection port that allows the drive circuit chamber to be in communication with the outside thereof. The hermetic sealing inspection port includes a valve opening and closing the hermetic sealing inspection port. The drive circuit chamber can be pressurized or depressurized through the hermetic sealing inspection port. The hermetic sealing inspection is conducted by connecting an outside fluid machine to the hermetic sealing inspection port through a detachable tube. The fluid machine is operated so as to depressurize or pressurize the drive circuit chamber through the hermetic sealing inspection port. The pressure in the drive circuit chamber is measured by a pressure meter provided in the tube.

3 Claims, 4 Drawing Sheets

(51) Int. Cl.

| | |
|---|---|
| ***F04B 39/12*** | (2006.01) |
| ***F04B 51/00*** | (2006.01) |
| ***F04C 23/00*** | (2006.01) |
| *F04C 18/02* | (2006.01) |

(52) U.S. Cl.

CPC ..... *F04C 23/008* (2013.01); *F04C 18/0215* (2013.01); *F04C 2220/40* (2013.01); *F04C 2240/803* (2013.01); *F04C 2240/808* (2013.01); *F04C 2270/80* (2013.01)

(56) References Cited

U.S. PATENT DOCUMENTS

| | | | | |
|---|---|---|---|---|
| 2004/0048131 | A1 | 3/2004 | Canepa et al. | |
| 2007/0115707 | A1 | 5/2007 | Koide | |
| 2010/0196175 | A1* | 8/2010 | Bedell et al. | 417/410.5 |
| 2011/0265894 | A1* | 11/2011 | Yamamoto | 137/544 |

FOREIGN PATENT DOCUMENTS

| | | | | |
|---|---|---|---|---|
| CN | 101788372 | A | | 7/2010 |
| EP | 1 336 760 | A2 | | 8/2003 |
| JP | 3065777 | U | | 11/1999 |
| JP | 2004-60454 | A | | 2/2004 |
| JP | 2004316615 | A | * | 11/2004 |
| JP | 2005-105962 | A1 | | 4/2005 |
| JP | 2008-074189 | A | | 4/2008 |
| JP | 2009287440 | A | * | 12/2009 |

OTHER PUBLICATIONS

Machine Translation of Abstract for JP2004316615A dated Nov. 2004.*

Extended European Search Report for corresponding EP Patent Application No. 13150925.9 issued on May 8, 2013.

* cited by examiner

MOTOR DRIVEN COMPRESSOR AND HERMETIC SEALING INSPECTION METHOD FOR THE SAME

BACKGROUND OF THE INVENTION

The present invention relates to a motor-driven compressor and a hermetic sealing inspection method for the same.

Japanese Utility Model Application Registration No. 3065777 discloses a device for inspecting whether or not a specimen is hermetically sealed.

A motor-driven compressor includes a housing, an inverter chamber formed in the housing and an inverter as an electric component accommodated in the inverter chamber. The hermetic sealing inspection for the inverter chamber is conducted for preventing moisture, dust and the like from entering into the inverter chamber. The hermetic sealing inspection is conducted through the use of a power supply cable (a high-tension cable) that extends from the inverter to the outside of the housing. In other words, air in the inverter chamber is drawn from a connector of the power supply cable through an internal space thereof, so that the inverter chamber is evacuated. Whether or not the inverter chamber is hermetically sealed is determined from the vacuum state holding time.

However, the length of the power supply cable of the motor-driven compressor depends on an apparatus on which the motor-driven compressor is mounted and also a demand from a customer of the motor-driven compressor, so that there are some cases in which the power supply cable of the motor-driven compressor is long. When the inverter chamber is evacuated through the long power supply cable having a small internal space thereof, it takes a long time until the inverter chamber is evacuated. Consequently, it results in an increase in time required for inspecting whether or not the inverter chamber is hermetically sealed. Therefore, it causes a decrease in productivity of the motor-driven compressor.

The present invention is directed to providing a motor-driven compressor and a hermetic sealing inspection method for the same which can reduce the time required for the hermetic sealing inspection.

SUMMARY OF THE INVENTION

A motor-driven compressor includes a compression mechanism compressing and discharging fluid, an electric motor driving the compression mechanism, a drive circuit controlling the electric motor, a drive circuit chamber accommodating the drive circuit and a hermetic sealing inspection port that allows the drive circuit chamber to be in communication with the outside thereof. The hermetic sealing inspection port includes a valve opening and closing the hermetic sealing inspection port. The drive circuit chamber can be pressurized or depressurized through the hermetic sealing inspection port. The hermetic sealing inspection is conducted by connecting an outside fluid machine to the hermetic sealing inspection port through a detachable tube. The fluid machine is operated so as to depressurize or pressurize the drive circuit chamber through the hermetic sealing inspection port. The pressure in the drive circuit chamber is measured by a pressure meter provided in the tube.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims.

The invention together with objects and advantages thereof, may best be understood by reference to the following description of the presently preferred embodiments together with the accompanying drawings in which.

DETAILED DESCRIPTION OF THE PREFERRED EMBODIMENTS

The following will describe the motor-driven compressor and the hermetic sealing inspection for the same according to the preferred embodiment of the present invention with reference to accompanied drawings.

Figure 1:
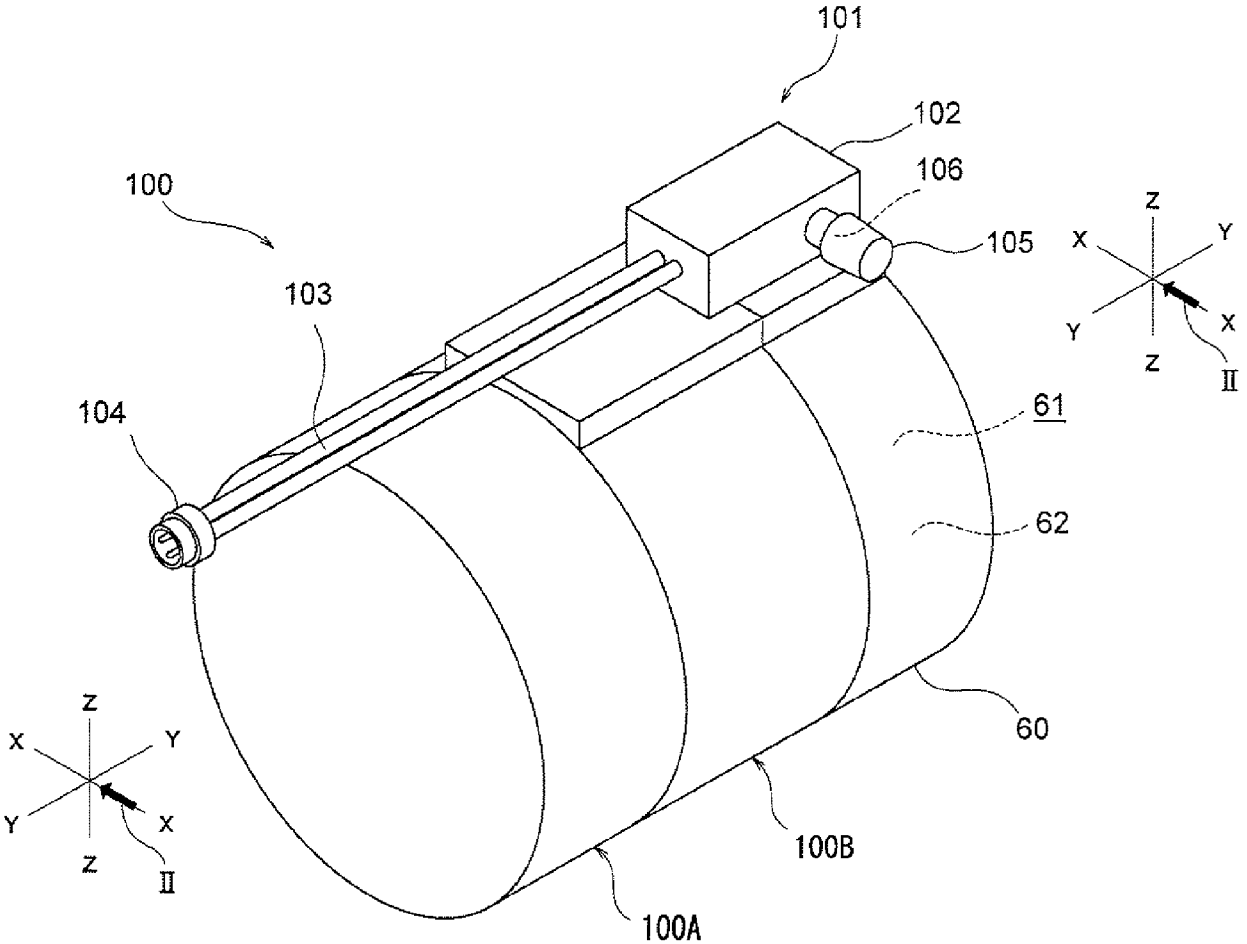
FIG. 1 is a schematic perspective view showing a motor-driven compressor according to a preferred embodiment of the present invention.
Figure 2:
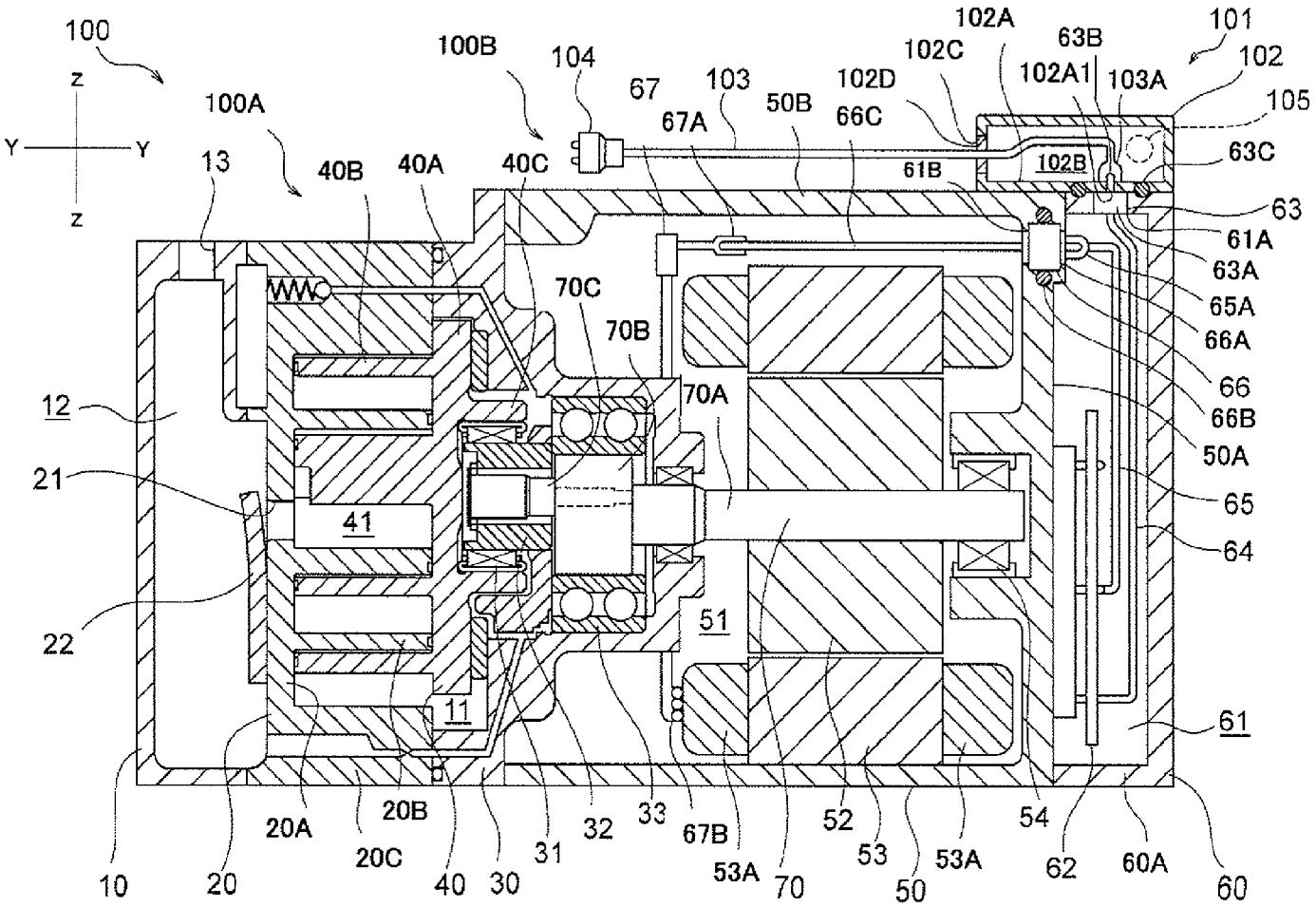
FIG. 2 is a schematic longitudinal cross sectional view of the motor-driven compressor of FIG. 1.

Referring to FIGS. 1 and 2, the motor-driven compressor according to the preferred embodiment is generally designated by numeral 100. In the embodiment, the motor-driven compressor 100 is of a scroll type compressor that draws, compresses and discharges refrigerant gas as fluid.

The motor-driven compressor 100 includes a second housing 20 forming a fixed scroll member, a first housing 10 and a third housing 30 both integrally joined to opposite ends of the second housing 20, respectively and a motor housing 50 integrally joined to the third housing 30 on the opposite side thereof from the second housing 20. The motor-driven compressor 100 also includes an inverter housing 60 integrally joined to the motor housing 50 on the opposite side thereof from the third housing 30. The first housing 10, the second housing 20, the third housing 30, the motor housing 50 and the inverter housing 60 cooperate to form a housing of the motor-driven compressor 100.

The second housing 20 integrally includes a fixed base wall 20A, a fixed scroll wall 20B that is formed spirally on the fixed base wall 20A and extends therefrom toward the third housing 30 and a peripheral wall 20C that surrounds the fixed scroll wall 20B.

The first housing 10 is joined to the end surface of the fixed base wall 20A of the second housing 20. The first housing 10 and the second housing 20 cooperate to form a discharge chamber 12. The discharge chamber 12 is in communication with the outside of the motor-driven compressor 100 via an outlet 13 formed through the first housing 10.

The motor-driven compressor 100 also includes a movable scroll member 40 between the second housing 20 and the third housing 30. The movable scroll member 40 integrally includes a movable base wall 40A that faces the fixed base wall 20A of the second housing 20 and a movable scroll wall 40B that is formed spirally on the movable base wall 40A and extends therefrom toward the fixed base wall 20A. The movable scroll wall 40B of the movable scroll member 40 engages with the fixed scroll wall 20B of the second housing 20 thereby to define therebetween falcated compression chambers 41. The periphery of the movable base wall 40A of the movable scroll member 40 and the third housing 30 cooperate to define a suction chamber 11 therebetween. The suction chamber 11 is in communication with the outside of the motor-driven compressor 100 via a suction port (not shown).

The compression chamber 41 is in communication with the suction chamber 11 on the peripheral wall 20C side of the second housing 20. The compression chamber 41 is communicable with the discharge chamber 12 at the center of the fixed base wall 20A of the second housing 20 via an discharge port 21 formed through the fixed base wall 20A at the center thereof. The discharge port 21 is opened and closed by a plate-like discharge valve 22 fixed to the fixed base wall 20A on the discharge chamber 12 side.

The motor-driven compressor 100 also includes a drive shaft 70 that is fitted in a cylindrical shaft support 40C that extends from the movable base wall 40A of the movable scroll member 40 on the opposite side of the movable base wall 40A from the movable scroll wall 40B. The drive shaft 70 integrally includes an eccentric shaft portion 70C that is rotatably fitted in the shaft support 40C via a bush 32 and a bearing 31, a large diameter portion 70B having a diameter larger than that of the eccentric shaft portion 70C and a main shaft portion 70A that extends into the motor housing 50 from the large diameter portion 70B on the opposite side thereof from the eccentric shaft portion 70C. The large diameter portion 70B is rotatably supported by the third housing 30 via a bearing 33. The center axis of the eccentric shaft portion 70C is offset from the common center axis of the main shaft portion 70A and the large diameter portion 70B.

Therefore, while the main shaft portion 70A of the drive shaft 70 is rotated, the eccentric shaft portion 70C orbits around the center axis of the main shaft portion 70A. Accordingly, the movable scroll member 40 orbits around the center axis of the main shaft portion 70A of the drive shaft 70. The compression chamber 41 formed on the suction chamber 11 side is moved radially inwardly toward the discharge port 21 in the center of the fixed base wall 20A by the orbital movement of the movable scroll member 40 and the volume of the compression chamber 41 is progressively reduced, so that refrigerant gas in the compression chamber 41 is compressed.

The second housing (the fixed scroll member) 20, the movable scroll member 40 and the drive shaft 70 cooperate to form a compression mechanism 100A for compressing refrigerant gas.

The motor housing 50 includes an end wall 50A and a peripheral wall 50B. The motor housing 50 and the third housing 30 cooperate to form a motor chamber 51 in the interior of the motor housing 50. The motor housing 50 rotatably supports the main shaft portion 70A of the drive shaft 70 via a bearing 54. In the motor chamber 51, a rotor 52 is fixed on the main shaft portion 70A of the drive shaft 70 for integral rotation therewith and a stator 53 including a coil 53A is fixed to the motor housing 50 so as to surround the rotor 52. When an alternating current flows to the coil 53A, the rotor 52 is rotated for integral rotation with the main shaft portion 70A of the drive shaft 70 by the stator 53.

The rotor 52, the stator 53, and the coil 53A cooperate to form an electric motor 100B for driving the compression mechanism 100A.

Therefore, when a voltage is supplied to the motor-driven compressor 100 by an external power supply, the alternating current is supplied to the coil 53A, the rotor 52 rotates integrally with the drive shaft 70 and the movable scroll member 40 orbits around the center axis of the main shaft portion 70A of the drive shaft 70. Accordingly, the compression chambers 41 that are formed between the movable scroll wall 40B of the movable scroll member 40 and the fixed scroll wall 20B of the second housing (the fixed scroll member) 20 are radially inwardly moved and progressively reduced in volume by the orbital movement of the movable scroll member 40. During the compression process, refrigerant gas containing lubrication oil is drawn from the suction chamber 11 into the compression chamber 41. Refrigerant gas containing lubrication oil that is compressed in the compression chamber 41 is discharged to the discharge chamber 12 through the discharge port 21 while pushing open the discharge valve 22. While refrigerant gas is drawn into the compression chambers 41 and discharged therefrom through the discharge port 21, lubrication oil contained in refrigerant gas lubricates sliding portions of the movable scroll member 40 and the second housing (the fixed scroll member) 20.

The inverter housing 60 and the motor housing 50 cooperate to form an inverter chamber 61 in the interior of the inverter housing 60. An inverter 62 is provided in the inverter chamber 61. The inverter 62 controls electric power supplied from the external power supply, supplies the controlled electric power to the coil 53A and controls the operation of the rotor 52. The inverter 62 that is an electric component including an electronic device is fixed to the end wall 50A of the motor housing 50 within the inverter chamber 61.

The inverter 62 and the inverter chamber 61 serve as the drive circuit and the drive circuit chamber of the present invention, respectively.

The inverter housing 60 includes a peripheral wall 60A having formed therethrough a first hole 61A that allows the inverter chamber 61 to be in communication with the outside thereof and a terminal 63 is fitted in the first hole 61A.

Figure 3:
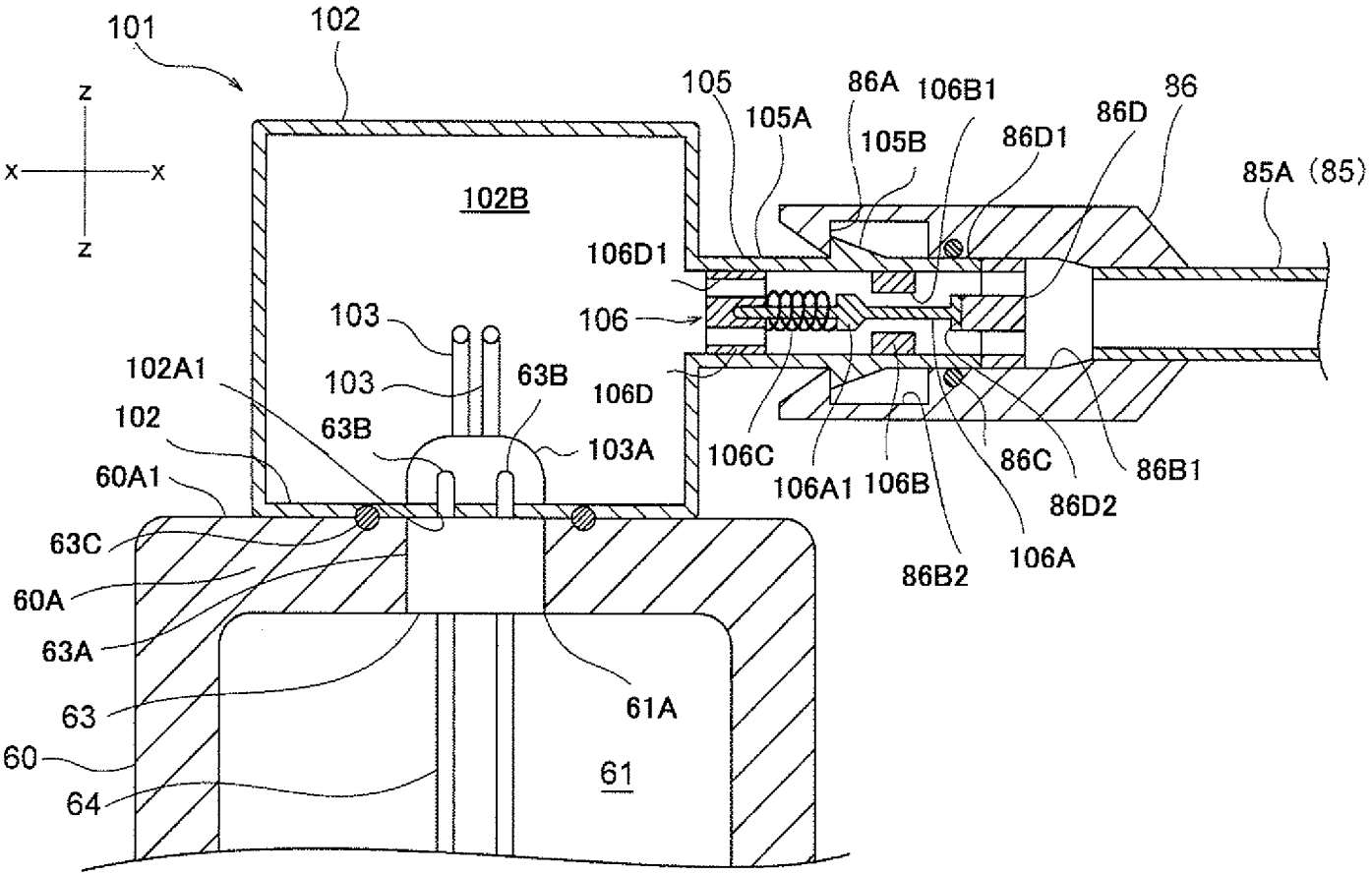
FIG. 3 is an enlarged fragmentary schematic traverse cross sectional view showing a power supply cable unit of the motor-driven compressor of FIG. 2 viewed from a y-y direction.

Referring to FIGS. 2 and 3, the terminal 63 includes a terminal body 63A and a terminal pin 63B.

The terminal pin 63B projects from the peripheral wall 60A toward the outside of the inverter housing 60. An o-ring 63C is provided on outer surface 60A1 of the peripheral wall 60A so as to surround the terminal pin 63B. The a-ring 63C is also provided so as to protrude from the outer surface 60A1 along the circumferential direction of the o-ring 63C. The terminal 63 is electrically connected to the inverter 62 by a first cable 64 within the inverter chamber 61.

The motor housing 50 includes the end wall 50A having formed therethrough a second hole 61B that allows the inverter chamber 61 to be in communication with the motor chamber 51. A hermetic terminal 66 is fitted in the second hole 61B. The hermetic terminal 66 includes a terminal body 66A, an o-ring 66B that surrounds the outer peripheral surface of the terminal body 66A and a conductive member 66C. The o-ring 66B serves to seal between the terminal body 66A and inner surface of the second hole 61B so as to ensure the hermetic sealing between the motor chamber 51 and the inverter chamber 61. Therefore, the hermetic terminal 66 closes the second hole 61B hermetically. As a result, the communication between the inverter chamber 61 and the motor chamber 51 is blocked hermetically by the hermetic terminal 66.

The conductive member 66C of the hermetic terminal 66 projects from the terminal body 66A into the inverter chamber 61 and also extends in the motor chamber 51 between the peripheral wall 50B of the motor housing 50 and the stator 53. A second cable 65 extending from the inverter 62 has at one end of the second cable 65 a socket 65A that is connected to the conductive member 66C that projects from the terminal body 66A. Therefore, the inverter 62 is electrically connected to the conductive member 66C through the second cable 65.

A motor harness 67 has at opposite ends thereof a socket 67A and a connection terminal 67B, respectively. The socket 67A is connected to the conductive member 66C at the end thereof in the motor chamber 51. The motor harness 67 is electrically connected to the coil 53A of the stator 53 through the connection terminal 67B.

Electric power is supplied from the terminal 63 to the inverter 62 through the first cable 64 and adjusted by the inverter 62. The adjusted electric power is supplied to the coil 53A of the stator 53 through the second cable 65, the hermetic terminal 66 and the motor harness 67.

The motor-driven compressor 100 includes a power supply cable unit 101 that is mounted on the peripheral wall 60A of the inverter housing 60 from outside.

The power supply cable unit 101 includes a box-shaped main unit 102 that is mounted on the peripheral wall 60A at a position where the terminal pin 63B of the terminal 63 projects, a power supply cable 103 that extends from an internal space 102B of the main unit 102 to the outside thereof through a hole 102C formed through the main unit 102 and a power supply connector 104 connected to one end of the power supply cable 103. The power supply cable 103 is connected at the other end thereof to a cable socket 103A. The power supply connector 104 is connected to a connector of a cable that extends from the external power supply for receiving the electric power.

The main unit 102 includes a bottom 102A having formed therethrough an insertion hole 102A1 through which the terminal pin 63B of the terminal 63 is inserted. The main unit 102 is fixed on the peripheral wall 60A of the inverter housing 60 by bolts or the like so that the terminal pin 63B is inserted through the insertion hole 102A1. At this time, the bottom 102A covers entirely the o-ring 63C provided on the inverter housing 60 and comes into contact with the o-ring 63C. As a result, the inverter chamber 61 around the terminal pin 63B of the terminal 63 and the internal space 1028 of the main unit 102 are isolated from the outside securely by the o-ring 63C. The inverter chamber 61 and the internal space 102B of the main unit 102 are in communication with each other through the periphery of the terminal 63 (or clearance between the terminal body 63A and the first hole 61A).

The cable socket 103A is attached to the bottom 102A of the main unit 102 at the position of the insertion hole 102A1 so that the terminal pin 63B of the terminal 63 is inserted into the cable socket 103A. The terminal pin 63B is electrically connected to the power supply cable 103 through the cable socket 103A.

A seal member 102D is provided in the hole 102C of the main unit 102 through which the power supply cable 103 is inserted. Therefore, the internal space 102B of the main unit 102 and the inverter chamber 61 are sealed hermetically from the outside by the seal member 102D.

Figure 4:
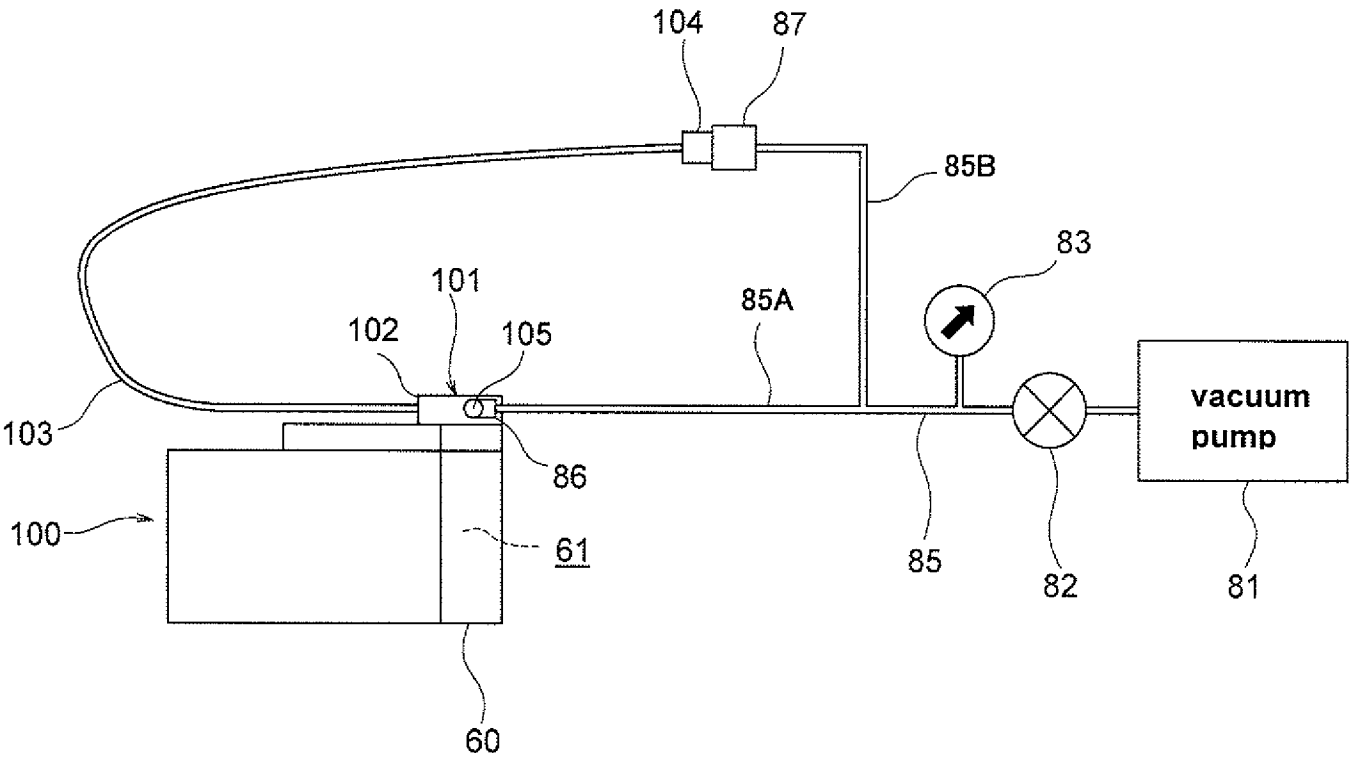
FIG. 4 is a schematic view describing a manner of hermetic sealing inspection for the motor-driven compressor according to the preferred embodiment of the present invention.

The main unit 102 includes a substantially cylindrical hermetic sealing inspection port 105 that projects from the outer surface of the main unit 102. The hermetic sealing inspection port 105 allows the internal space 102B of the main unit 102 to be in communication with the outside thereof. Referring to FIG. 4, an air hose 85 that extends from a vacuum pump 81 is bifurcated into a first air hose 85A and a second air hose 85B. The first air hose 85A is connected at one end thereof to a first connector 86 (to be described later) and at the other end thereof to the vacuum pump 81 through the air hose 85. The second air hose 85B is connected at one end thereof a second connector 87 and at the other end thereof to the vacuum pump 81 through the air hose 85. The first connector 86 and the second connector 87 serve as the connector of the present invention. The air hose 85, the first air hose 85A and the second air hose 85B serve as the tube of the present invention for flowing fluid. The hermetic sealing inspection port 105 has a coupler structure that is engageable with the first connector 86. Therefore, the internal space 102B of the main unit 102 can be in communication with the vacuum pump through the hermetic sealing inspection port 105, the first air hose 85A and the air hose 85.

The hermetic sealing inspection port 105 includes a tubular portion 105A that projects from the main unit 102 and is formed integrally therewith and an annular projection 105B that has a substantially rectangular triangle shape in longitudinal cross section thereof and formed on the outer peripheral surface of the tubular portion 105A integrally therewith. The annular projection 105B is tapered toward the distal end of the tubular portion 105A.

A valve 106 is provided in an internal space of the tubular portion 105A.

The valve 106 includes a valve support member 106D arranged in and fixed to the internal space of the tubular portion 105A on the main unit 102 side of the tubular portion 105A and a valve shaft 106A inserted into the valve support member 106D. The valve shaft 106A is supported by the valve support member 106D so as to be movable in the axial direction of the tubular portion 105A. The valve support member 106D has formed therethrough radially outward of the axis thereof a hole 106D1 through which the internal space of the tubular portion 105A is in communication with the internal space 102B of the main unit 102. The valve shaft 106A has a valve body 106A1 that has a radially expanded portion and a truncated circular cone portion that are integrally formed.

The valve 106 further includes a cylindrical valve seat member 106B arranged in and fixed to the tubular portion 105A at a position adjacent to the distal end thereof more than the valve body 106A1. The valve seat member 106B has formed therethrough a hole 106B1 through which the valve shaft 106A passes. The valve 106 further includes a spring 106C that is provided between the valve body 106A1 of the valve shaft 106A and the valve support member 106D. The spring 106C urges the valve body 106A1 toward the hole 106B1 of the valve seat member 106B so that the valve body 106A1 closes the hole 106B1. On the other hand, when the valve shaft 106A extending from the valve body 106A1 and passing through the valve seat member 106B is pushed toward the valve support member 106D from the distal end side of the valve shaft 106A, the valve body 106A1 opens the hole 106B1.

The first connector 86 is cylindrically-shaped and made of a flexible material. The first connector 86 includes a cylindrical inner surface 86B1 that is engageable with the outer surface of the tubular portion 105A. The first connector 86 further includes an annular seal member 86C so that a part thereof is embedded in the inner surface 86B1. The first connector 86 further includes on the distal end side thereof another inner surface 86B2 having a diameter larger than those of the annular projection 105B and the inner surface 86B1 so as to receive the annular projection 105B. A part of the first connector 86 where the inner surface 86B2 is located is divided into a plurality of regions in a circumferential direction thereof by the same number of slits (not shown) that extend in the axial direction of the first connector 86. The same number of connection hooks 86A are formed at the divided regions so as to project inward from the inner surface 86B2.

The first connector 86 further includes a stopper 86D that is fixed on the inner surface 86B1 of the first connector 86. The stopper 86D includes a contact surface 86D1 and a center projection 86D2. When the hermetic sealing inspection port 105 is plugged into the first connector 86, the contact surface 86D1 comes into contact with the tubular portion 105A and the center projection 86D2 pushes and moves the valve shaft 106A toward the valve support member 106D thereby to open the hole 106B1, so that the fluid can flow between the contact surface 86D1 and the center projection 86D2.

Therefore, when the hermetic sealing inspection port 105 is inserted into the first connector 86, the connection hooks 86A of the first connector 86 climb over the annular projection 105B of the tubular portion 105A of the hermetic sealing inspection port 105, so that the first connector 86 is engaged with the hermetic sealing inspection port 105 through a snap-fit connection. At this time, the tubular portion 105A comes into contact with the contact surface 86D1 of the stopper 86D of the first connector 86, so that the first connector 86 is fixed to the hermetic sealing inspection port 105. At the same time, the center projection 86D2 of the stopper 86D pushes the valve shaft 106A toward the valve support member 106D, so that the valve body 106A1 moves away from the valve seat member 106B thereby to open the hole 106B1 of the valve seat member 106B with the result that the internal space of the first air hose 85A is in communication with the internal space 102B of the main unit 102. The seal member 86C maintains hermetic sealing between the tubular portion 105A and the first connector 86.

The first connector 86 can be detached from the hermetic sealing inspection port 105 by pulling out the first connector 86 from the hermetic sealing inspection port 105 while expanding the connection hook 86A of the first connector 86 radially outward thereof. At this time, the valve body 106A1 moves toward the valve seat member 106B with the valve shaft 106A by the urging force of the spring 106C, so that the valve body 106A1 comes into contact with the valve seat member 1068 thereby to close the hole 106B1. Therefore, the internal space 102B of the main unit 102 is isolated from the outside of the hermetic sealing inspection port 105, so that the hermetic sealing therebetween is maintained.

In the motor-driven compressor 100 shown in FIGS. 1 and 2, refrigerant gas containing lubrication oil and circulating through the motor-driven compressor 100 and moisture and dust in the outside of the motor-driven compressor 100 need be prevented from entering into the inverter chamber 61 accommodating the inverter 62 as the electric component. Therefore, the inverter chamber 61 need be isolated from the motor chamber 51 and the outside of the motor-driven compressor 100 so as to hermetically seal the inverter chamber 61. Thus, the hermetic sealing inspection of the inverter chamber 61 in the motor-driven compressor 100 is conducted in the manufacturing process, i.e. somewhere in a manufacturing line of the motor-driven compressor 100.

Referring to FIG. 4, the hermetic sealing inspection for the inverter chamber 61 (refer to FIG. 2) is conducted in such a way that the inverter chamber 61 is depressurized to predetermined pressure (vacuum pressure) by a vacuum pump 81 as a fluid machine, subsequently the depressurization by the vacuum pump 81 is stopped and the pressure change in the inverter chamber 61 with time is measured after the stop of the depressurization.

As described previously, the first connector 86 is connected to the hermetic sealing inspection port 105.

The second connector 87 is connected to the power supply connector 104 of the motor-driven compressor 100 in such a way as to hermetically seal the second connector 87 and the power supply connector 104 from the outside when connected.

A flow control valve 82 is provided in the air hose 85 somewhere more adjacent to the vacuum pump 81 than the first air hose 85A and the second air hose 85B for adjusting a flow rate of the fluid flowing through the air hose 85. A pressure meter 83 is also provided in the air hose 85 between the flow control valve 82 and a bifurcation point of the first air hose 85A and the second air hose 85B, i.e. upstream of the flow control valve 82.

Therefore, when the vacuum pump 81 is activated with the flow control valve 82 opened, the vacuum pump 81 draws air through the air hose 85, the first air hose 85A and the second air hose 85B.

Referring to FIGS. 2 and 3, air in the internal space 102B of the main unit 102 in the power supply cable unit 101 is drawn through the first air hose 85A, the first connector 86 and the hermetic sealing inspection port 105. Accordingly, air in the inverter chamber 61 is drawn through the clearance between the terminal body 63A of the terminal 63 and the first hole 61A.

In other words, air in the inverter chamber 61 is drawn by the vacuum pump 81 through the periphery of the terminal 63 (or the clearance between the terminal body 63A and the first hole 61A), the internal space 102B of the main unit 102, the hermetic sealing inspection port 105, the first connector 86, the first air hose 85A and the air hose 85.

Air in internal space of the power supply cable 103 is drawn through the periphery of a terminal in the power supply connector 104, the second connector 87 and the second air hose 85B. Therefore, air in the inverter chamber 61 is also drawn through the clearance between the terminal body 63A of the terminal 63 and the first hole 61A and the internal space of the cable socket 103A.

In other words, air in the inverter chamber 61 is also drawn by the vacuum pump 81 through the periphery of the terminal 63 (or the clearance between the terminal body 63A and the first hole 61A), the internal space of the is cable socket 103A, the internal space of the power supply cable 103, the power supply connector 104, the second connector 87, the second air hose 85B and the air hose 85.

When the pressure shown by the pressure meter 83 reaches the predetermined pressure (vacuum pressure), the flow control valve 82 is activated to close the air hose 85 and the vacuum pump 81 is stopped. When the pressure meter 83 shows the predetermined pressure for a predetermined time after the vacuum pump 81 is stopped, it is determined that the inverter chamber 61 is hermetically sealed.

On the other hand, when the pressure shown by the pressure meter 83 does not reach the predetermined pressure even if the vacuum pump 81 is operated and also when the pressure shown by the pressure meter 83 rises within a predetermined time after the flow control valve 82 is closed, it is determined that air flows into the inverter chamber 61 from the outside and the hermetic sealing is not maintained.

In the motor-driven compressor 100 according to the embodiment, air in the inverter chamber 61 is drawn through the hermetic sealing inspection port 105 in the hermetic sealing inspection, so that the number of channels of drawing air can be increased more and the length of the channel can be decreased more as compared with a case where air is drawn only through the power supply cable 103, with the result that the pressure in the inverter chamber 61 can be reduced to the predetermined pressure (vacuum pressure) more quickly. Specifically, in the hermetic sealing inspection for the motor-driven compressor 100, air in the inverter chamber 61 is drawn through two channels, i.e. through the power supply cable 103 and through the hermetic sealing inspection port 105. Therefore, the time required for reducing the pressure in the inverter chamber 61 to the predetermined pressure (vacuum pressure) is further reduced.

The motor-driven compressor 100 according to the present invention includes the compression mechanism 100A that compresses and discharges refrigerant gas, the electric motor 1008 that drives the compression mechanism 100A, the inverter 62 that controls the operation of the electric motor 100B, the inverter chamber 61 that accommodates the inverter 62 and the hermetic sealing inspection port 105 through which the inverter chamber 61 can be in communication with the outside. The hermetic sealing inspection port 105 includes the valve 106 that opens or closes the hermetic sealing inspection port 105. The inverter chamber 61 can be pressurized or depressurized through the hermetic sealing inspection port 105.

The hermetic sealing inspection port 105 that is specifically designed for the hermetic sealing inspection for the inverter chamber 61 is provided for the motor-driven compressor 100. The hermetic sealing inspection is conducted only by connecting the tube that extends from the fluid machine such as the vacuum pump 81 to the hermetic sealing inspection port 105, so that the hermetic sealing inspection can be conducted easily. Furthermore, as compared with a case in which the inverter chamber 61 is pressurized or depressurized only through the power supply cable 103 connected to the tube that extends from the fluid machine, in the hermetic sealing inspection method of the present invention in which the inverter chamber 61 is pressurized or depressurized through the hermetic sealing inspection port 105 connected to the tube that extends from the fluid machine, it is possible to shorten a distance between the inverter chamber 61 and the hermetic sealing inspection port 105 serving as the connection to the tube and also to increase the cross-sectional area of an air passage between the inverter chamber 61 and the hermetic sealing inspection port 105. Therefore, the motor-driven compressor 100 can reduce the time for pressurizing or depressurizing the inverter chamber 61 and also for conducting the hermetic sealing inspection.

In the motor-driven compressor 100, the hermetic sealing inspection port 105 is connectable to the first connector 86 of the tube that extends from the fluid machine for pressurizing or depressurizing the inverter chamber 61. When the first connector 86 is connected to the hermetic sealing inspection port 105, the valve 106 opens the hermetic sealing inspection port 105. When the first connector 86 is detached from the hermetic sealing inspection port 105, the valve 106 closes the hermetic sealing inspection port 105. The first connector 86 can be engaged with and connected to the hermetic sealing inspection port 105 through a snap-fit connection easily, so that it is easy to attach and detach the first connector 86 to and from the hermetic sealing inspection port 105, respectively and accordingly, it is easy to open and close the valve 106. Therefore, it is possible to reduce the time required for the hermetic sealing inspection.

The motor-driven compressor 100 further includes the inverter housing 60 forming the inverter chamber 61, the terminal 63 exposed on the surface of the inverter housing 60 and electrically connected to the inverter 62 and the power supply cable unit 101 including the main unit 102 which is attachable to the inverter housing 60 and through which the power supply cable 103 extends. When the main unit 102 is attached to the inverter housing 60, the power supply cable 103 is electrically connected to the terminal 63. The hermetic sealing inspection port 105 is provided in the main unit 102 of the power supply cable unit 101. The hermetic sealing inspection port 105 is in communication with the inverter chamber 61 through the main unit 102. Therefore, it is possible to provide the hermetic sealing inspection port 105 merely by attaching the power supply cable unit 101 to any type of motor-driven compressor without modifying it.

In the hermetic sealing inspection for the motor-driven compressor 100 according to the embodiment, the inverter chamber 61 is evacuated by the vacuum pump 81. However, the present invention is not limited to this. The inverter chamber 61 may be pressurized by an air compressor and the predetermined high pressure holding time may be measured after the pressurization.

In the motor-driven compressor 100 according to this embodiment, the hermetic sealing inspection port 105 is provided in the power supply cable unit 101. However, the present invention is not limited to this. The hermetic sealing inspection port 105 may be provided in the inverter housing 60.

In the motor-driven compressor 100 according to this embodiment, the inverter chamber 61 and the internal space 102B of the main unit 102 are in communication with each other through the periphery of the terminal 63. However, a communication hole may be formed through the terminal body 63A of the terminal 63 for the fluid communication between the inverter chamber 61 and the internal space 102B of the main unit 102. Alternatively, a communication hole may be formed through the inverter housing 60 and the main unit 102 for the fluid communication between the inverter chamber 61 and the internal space 102B of the main unit 102.

The motor-driven compressor 100 according to this embodiment is of a scroll type compressor. However, the present invention is not limited to this. The present invention is applicable to any type of compressor, e.g. a vane type compressor, having a space that has to be hermetically sealed.

What is claimed is:

1. A motor-driven compressor comprising:

a compression mechanism compressing and discharging fluid;

an electric motor driving the compression mechanism;

a drive circuit controlling the electric motor;

a housing including drive circuit chamber accommodating the drive circuit;

a terminal provided in the housing and exposed on an outer surface thereof and electrically connected to the drive circuit;

a power supply cable unit including a power supply cable and a main unit which is attachable to the housing and through which the power supply cable extends to the outside of the main unit, wherein the power supply cable is electrically connected to the terminal when the main unit is attached to the housing and a hermetic sealing inspection port that allows the drive circuit chamber to be in communication with the outside of the drive circuit chamber, wherein the hermetic sealing inspection port includes a valve opening and closing the hermetic sealing inspection port, wherein the drive circuit chamber can be pressurized or depressurized through the hermetic sealing inspection port and wherein the hermetic sealing inspection port is provided in the main unit of the power supply cable unit and in communication with the drive circuit chamber through the main unit.

2. The motor-driven compressor according to claim 1, wherein the hermetic sealing inspection port is connectable to a connector of a tube that extends from a fluid machine for pressurizing or depressurizing the drive circuit chamber, wherein the valve opens the hermetic sealing inspection port when the connector is connected to the hermetic sealing inspection port and closes the hermetic sealing inspection port when the connector is detached from the hermetic sealing inspection port.

3. The motor-driven compressor according to claim 2, wherein the connector can be engaged with and connected to the hermetic sealing inspection port through a snap-fit connection.

* * * * *